US009034202B2

(12) United States Patent
Mitchell et al.

(10) Patent No.: US 9,034,202 B2
(45) **Date of Patent: *May 19, 2015**

(54) FIRE SUPPRESSING MATERIALS AND SYSTEMS AND METHODS OF USE

(75) Inventors: Mark D. Mitchell, Simi Valley, CA (US); John F. Black, Los Angeles, CA (US); Kurt Mills, Ventura County, CA (US)

(73) Assignee: Meggitt Safety Systems Inc., Simi Valley, CA (US)

( * ) Notice: Subject to any disclaimer, the term of this patent is extended or adjusted under 35 U.S.C. 154(b) by 421 days.

This patent is subject to a terminal disclaimer.

(21) Appl. No.: 13/423,133

(22) Filed: Mar. 16, 2012

(65) Prior Publication Data

US 2013/0240218 A1 Sep. 19, 2013

(51) Int. Cl.
*A62D 1/00* (2006.01)
*A62D 1/02* (2006.01)
*A62C 35/00* (2006.01)

(52) U.S. Cl.
CPC ..... *A62D 1/0092* (2013.01); *A62C 35/00* (2013.01); *A62D 1/00* (2013.01)

(58) Field of Classification Search
None
See application file for complete search history.

(56) References Cited

U.S. PATENT DOCUMENTS

| | | | | |
|---|---|---|---|---|
| 5,444,102 | A * | 8/1995 | Nimitz et al. | 521/131 |
| 5,626,786 | A | 5/1997 | Huntington et al. | |
| 5,716,549 | A * | 2/1998 | Nimitz et al. | 252/364 |
| 6,315,219 | B1 | 11/2001 | Palestrant | |
| 6,478,929 | B1 * | 11/2002 | Parten | 203/17 |
| 7,083,742 | B1 * | 8/2006 | Nimitz et al. | 252/8 |
| 7,465,698 | B2 * | 12/2008 | Wilson et al. | 510/408 |
| 8,096,366 | B2 | 1/2012 | Gibson et al. | |
| 2003/0089877 | A1 | 5/2003 | Rivers et al. | |
| 2005/0082509 | A1 | 4/2005 | Sievert et al. | |
| 2005/0263738 | A1 | 12/2005 | Minor et al. | |
| 2008/0115950 | A1 | 5/2008 | Haaland et al. | |
| 2009/0188682 | A1 * | 7/2009 | Gensel et al. | 169/46 |
| 2009/0277194 | A1 * | 11/2009 | Minor et al. | 62/114 |
| 2012/0004299 | A1 * | 1/2012 | Hulse et al. | 514/475 |
| 2012/0145941 | A1 | 6/2012 | Gibson et al. | |
| 2013/0098638 | A1 | 4/2013 | Dunster et al. | |
| 2013/0098639 | A1 * | 4/2013 | Dunster et al. | 169/9 |
| 2013/0140045 | A1 * | 6/2013 | Habitzl | 169/16 |
| 2013/0186654 | A1 * | 7/2013 | Dunster et al. | 169/62 |
| 2013/0240217 | A1 * | 9/2013 | Mitchell et al. | 169/5 |
| 2013/0240218 | A1 | 9/2013 | Mitchell et al. | |
| 2014/0202719 | A1 * | 7/2014 | Senecal | 169/46 |

OTHER PUBLICATIONS

Robin, PhD, et al., *Clean Agent Fire Protection With Hydrofluorocarbons*, DuPont Fluroproducts, Presented at Fire India 2009, Retrieved from internet: <URL: http://agsurf.com/FE/en_US/assests/downloads/pdf/2009_FireIndia_paper.pdf>; pp. 1-15.

United Nations Environment Programme (UNEP), *Montreal Protocol on Substances That Deplete the Ozone Layer*, Dec. 2007, Retrieved from internet: <URL: http://ozone.unep.org/Assessment_Panels/TEAP/Reports/HTOC/Technical%20Note%201%20-%20New%20Technology%20Halon%20Alternatives%20-%Revision%203.pdf>; pp. 1-28.

International Search Report and Written Opinion of the International Searching Authority mailed on Jan. 14, 2014 for PCT/US2013/032195, International Filing Date: Mar. 25, 2013.

* cited by examiner

*Primary Examiner* — Joseph D Anthony
(74) *Attorney, Agent, or Firm* — Dickstein Shapiro LLP

(57) ABSTRACT

A fire suppressant mixture comprising: an organic or supplemental organic fire suppressant compound having a boiling point; and an organic compound with a boiling point lower than the boiling point of the organic fire suppressant compound, wherein the organic fire suppressant compound and the organic compound are combined such that a boiling point of the mixture is lower than the boiling point of the organic fire suppressant. In some embodiments, the organic fire suppressant compound is FK 5-1-12 and the organic compound is carbon dioxide. In other embodiments, the mixture is supplemented with an additional organic compound $CF_3I$ and an inorganic pressurizing gas, such as nitrogen.

15 Claims, 3 Drawing Sheets

FIRE SUPPRESSING MATERIALS AND SYSTEMS AND METHODS OF USE

The present patent document relates to fire suppressing materials and systems, and methods of using fire suppressing materials. More particularly, the present patent document relates to forming a mixture of an organic fire suppressant with another organic compound to modify a characteristic of the fire suppressant.

BACKGROUND

Aircraft operating conditions provide unique challenges for the design of aircraft fire suppression systems. For example, aircraft fire suppression systems must work at a wide range of temperatures. These temperature may range from +105° C. when the aircraft is on the tarmac on a hot day, to as low as −55° C. when the aircraft is at high altitudes.

For more than 50 years Halon 1301 has been the agent of choice for aircraft engine, auxiliary power unit (APU), and cargo fire suppression applications. Halon 1301 has a number of specific desirable properties that make it a popular choice for aircraft fire suppression systems. For example, Halon 1301 has a low boiling point and a high vapor pressure, which facilitates agent-air mixing and distribution throughout the fire zone. In addition, the −58° C. boiling point of Halon 1301 and its ability to freely vaporize at each point of discharge are desirable physical properties. However, due to the ozone depleting potential of Halon 1301 (Bromotrifluoromethane), manufacturing of the material ceased in most countries in 1995.

In many current systems, Halon 1301 is stored in a pressurized bottle, which uses nitrogen as a pressurizing gas. Nitrogen pressure beyond the natural vapor pressure of Halon 1301 is needed to provide system discharge energy at low temperatures. Nitrogen dissolved in the Halon solution also improves vaporization and breakup of liquid drops of Halon 1301 at low temperature similar to a "popcorn" effect.

Aircraft fire suppression systems are usually designed based on the weight of the agent required to achieve a specific minimum agent concentration in the fire zone immediately after the bottle discharges. The fire suppression system should be designed to function properly at the minimum operating temperature for the application. The minimum operating temperature is often the worst case scenario for the fire suppression system because agent vapor volume and vapor pressure decrease with decreasing temperature.

Another important consideration in the design of the fire suppression system is agent distribution. Agent distribution throughout the fire zone depends on the agent's ability to mix with air entering the fire zone at each discharge location. Presence of clutter in the fire zone may present challenges to the line-of-sight transport between the discharge location and the fire threat.

Currently, there are no known fire suppression and extinguishing compounds that have the characteristics and capabilities of Halon 1301 but are also environmentally friendly.

SUMMARY

In view of the foregoing, an object according to one aspect of the present patent document is to provide a fire suppressant mixture. In other aspects of document, methods and systems related thereto are provided. Preferably the provided methods, systems, and mixtures address, or at least ameliorate one or more of the problems described above. To this end, a fire suppressant mixture is provided. In one embodiment the fire suppressant mixture comprises: an organic fire suppressant compound having a boiling point; and an organic compound having a boiling point lower than the boiling point of the organic fire suppressant compound, wherein the organic fire suppressant compound and the organic compound are combined such that a boiling point of the mixture is lower than the boiling point of the organic fire suppressant.

In some embodiments, the fire suppressant mixture includes a fire suppressant compound known as FK-5-1-12, a Fluoroketone, chemically dodecafluoro-2-methylpentane-3. In other embodiments, the organic fire suppressant is $CF_3I$, trifluoroiodomethane. In yet other embodiments, the organic fire suppressant may be a compound substantially similar to FK-5-1-12 or $CF_3I$. In some embodiments, large high molecular weight organic molecules containing a halogen with boiling point temperature below that of FK-5-1-12 may be used. In still other embodiments of the fire suppressant mixture, more than one organic fire suppressant compound may be used. In some of those embodiments, both FK-5-1-12 and $CF_3I$ may be used.

The fire suppressant mixture may contain different organic compounds with a boiling point below that of the included organic fire suppressant compound. In some embodiments, the organic compound may be carbon dioxide. The organic compound may be mixed in any proportion with the organic fire suppressant. In a preferred embodiment, the mixture has an approximately 4 to 1 mass ratio of organic fire suppressant to organic compound. In some embodiments, more than one organic compound may be included in the mixture with the organic fire suppressant compound. In still yet other embodiments, multiple organic compounds may be mixed with multiple organic fire suppressant compounds.

In a preferred embodiment, the fire suppressant mixture that is formed is further pressurized by an inorganic gas. In some embodiments, the inorganic pressurizing gas is Nitrogen. In other embodiments it may be argon or helium or some other inert gas.

In some embodiments, the components of the fire suppressant mixture may be selected for particular characteristics or qualities they posses. For example, in some embodiments the components of the mixture may be selected based on environmental factors such as ozone depletion potential (ODP) and global warming potential (GWP). In such embodiments, the mixture may include an organic fire suppressant with an ODP of zero and a GWP of 1 or less.

In another aspect of the present patent document, a method of creating a fire suppressant mixture is provided. The method comprising the steps of: mixing an organic fire suppressant having a boiling point with an organic compound having a lower boiling point than the boiling point of the organic fire suppressant to form a fire suppressant mixture having a boiling point lower than the boiling point of the organic fire suppression compound.

In some embodiments of the method, the fire suppressant mixture may be pressurized with an inorganic gas. In some embodiments, the gas may be an inert gas. In a preferred embodiment, the gas is nitrogen.

In yet other embodiments of the method, the organic fire suppressant is FK-5-1-12, dodecafluoro-2-methylpentane-3-one or $CF_3I$, trifluoroiodomethane. In those embodiments, the organic compound may be carbon dioxide.

In another aspect of the present patent document, the fire suppressant mixtures described herein are used in an improved fire suppression system for distribution. The fire suppression system comprises: a storage container including a mixture of an organic fire suppressant compound having a boiling point and an organic compound having a lower boiling point than the boiling point of the organic fire suppressant.

In a preferred embodiment of the fire suppression system, the storage container is pressurized with an inorganic gas. In some embodiments of the fire suppression system the organic fire suppressant compound is FK-5-1-12, dodecafluoro-2-methylpentane-3-one or $CF_3I$, trifluoroiodomethane. In some of those embodiments, the organic compound is carbon dioxide.

In some embodiments of the fire suppression system, tubing may be used to distribute the fire suppression mixture to a discharge location. In such embodiments the geometry of the tubing may be designed to maintain a minimum pressure within the fire suppression system.

In other embodiments, the fire suppression system includes a distribution tubing and discharge geometries in communication with the distribution tubing at a plurality of discharge points, wherein the discharge exit geometry maintains a minimum pressure within the fire suppression system. In some of those embodiments, the discharge exit geometry comprises a nozzle that restricts the flow of the fire suppression mixture.

As described more fully below, the fire suppressant mixtures, systems, and methods described herein provide suitable alternatives to existing fire suppressants, particularly when used in cold temperature environments, such as those found in aircraft. Further aspects, objects, desirable features, and advantages of the mixtures, systems and methods disclosed herein will be better understood from the detailed description and drawings that follow in which various embodiments are illustrated by way of example. It is to be expressly understood, however, that the drawings are for the purpose of illustration only and are not intended as a definition of the limits of the claimed invention.

DETAILED DESCRIPTION OF THE EMBODIMENTS

Figure 1:
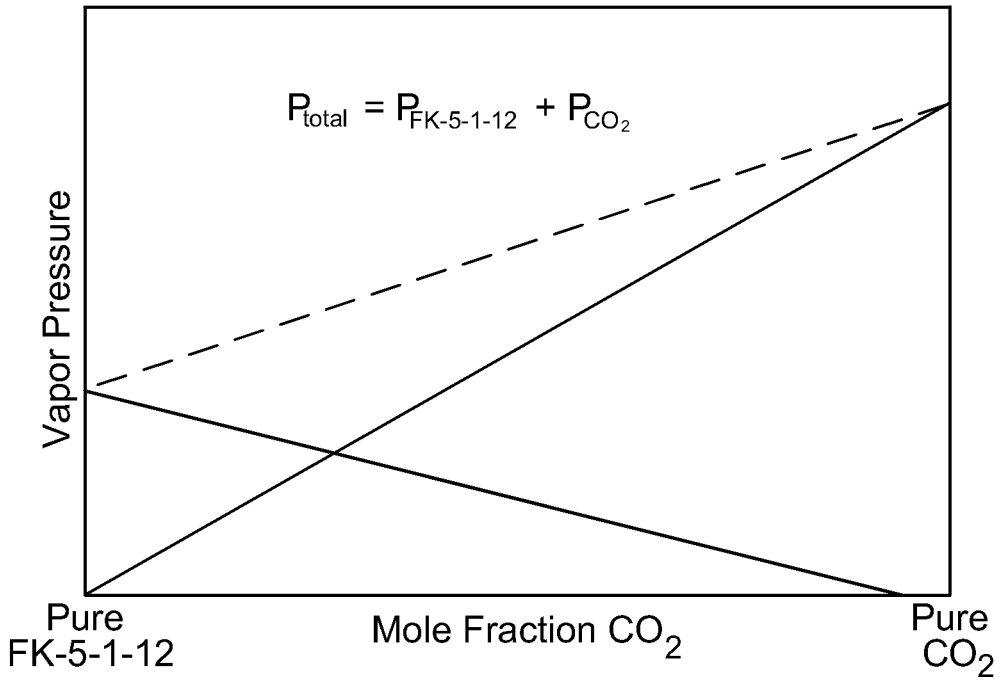
FIG. 1 illustrates how the vapor pressure, and thus the boiling point, of a mixture of dodecafluoro-2-methylpentane-3-one (FK-5-1-12) and $CO_2$ is affected by increasing the concentration of $CO_2$ in the mixture.
Figure 2:
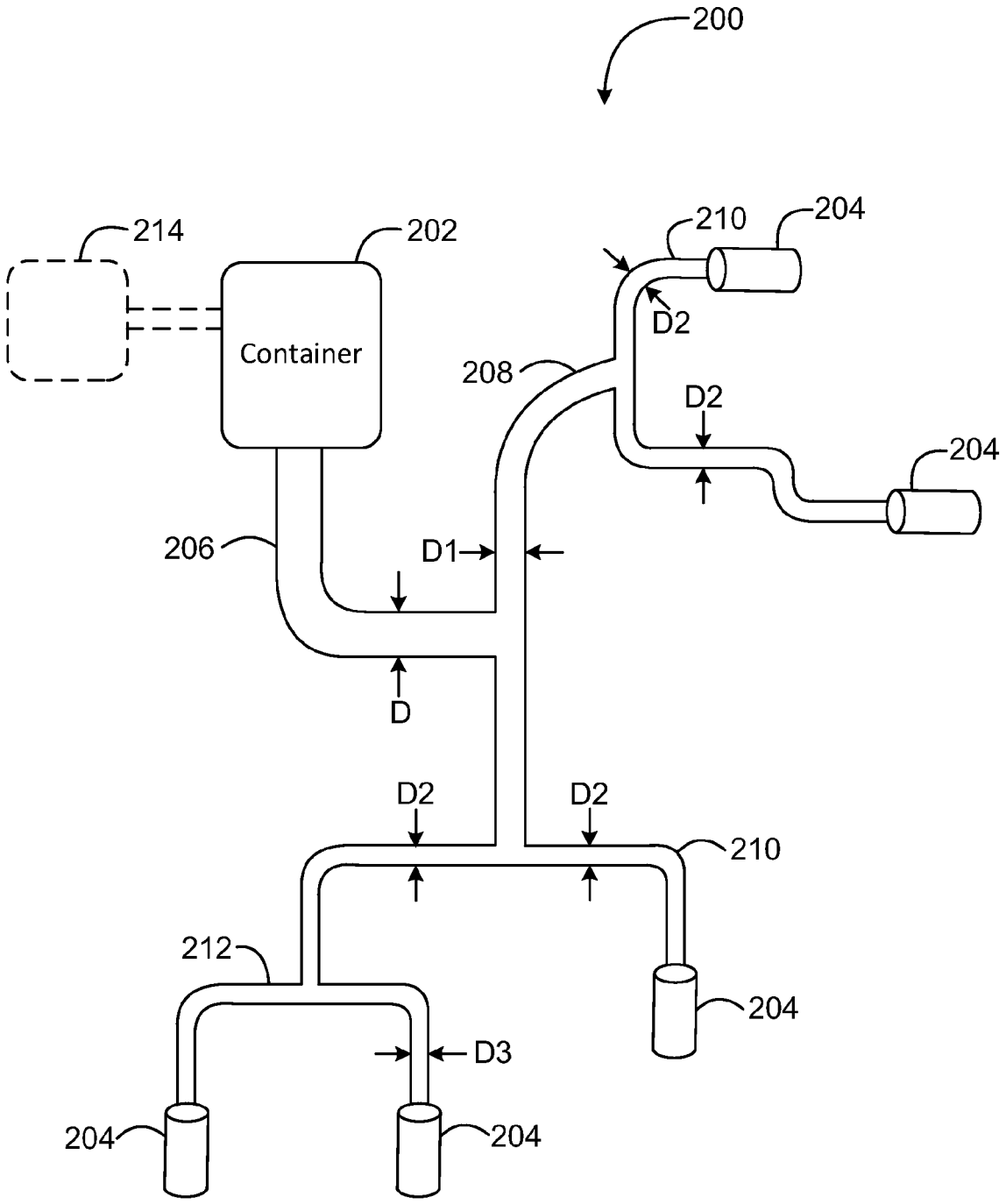
FIG. 2 illustrates a fire suppression system for distributing a fire suppression mixture.

The present patent document teaches the use of an organic blend of compounds to create a fire suppression agent. By using an organic blend of compounds comprised from component compounds, it is possible to create a mixture that retains desirable characteristics of each of its components. Accordingly, fire suppressing agents may be formed that have numerous desirable features of their components and are thus better suited to handle fire suppression in diverse environments like the ones found on aircraft. Blending component compounds together also means that a wider range of compounds may be used because all the desirable features do not necessarily have to be exhibited by a single component. In a preferred embodiment, an organic fire suppressant may be blended with a compatible compound to modify a physical property of the organic fire suppressant and make it more suitable for a particular application.

Although in a preferred embodiment a single organic fire suppressant compound is mixed with a single organic compound, in other embodiments more than one organic fire suppressant may be included in the components of the mixture or more than one organic compound may be included in the components of the mixture. For example, in some embodiments more than one organic fire suppressant compound may be combined with a single organic compound. In other embodiments, a single organic fire suppressant compound may be combined with multiple organic compounds. In still other embodiments, multiple organic fire suppressant compounds may be combined with multiple organic compounds.

As used herein, "organic compound" is used broadly to refer to any compound that includes carbon whether or not the organic compound would be considered a fire suppressant. In the preferred embodiment, the organic compound has fire suppressant characteristics.

In various embodiments, component compounds may be blended together to improve various different characteristics. For example, in some embodiments, an organic fire suppressant may be mixed with an organic compound with a lower boiling point to lower the boiling point of the resultant mixture. In other embodiments, other characteristics may be improved or modified. In a preferred embodiment, the components of the mixture are chosen such that the resultant mixture exhibits characteristics of improved fire suppression effectiveness and airborne weight efficiency.

When selecting component compounds to mix together, the characteristics of each component may be selected to achieve a resultant mixture with specific characteristics. One characteristic that may be considered in an embodiment of a new fire suppression agent is ozone depletion potential (ODP). In a preferred embodiment, the component compounds comprising the mixture have a lower ODP than Halon 1301 or at least are chosen such that the resultant mixture has an ODP less than Halon 1301. In a more preferable embodiment, the component compounds comprising the mixture have half or less the ODP of Halon 1301 or result in a mixture with half or less the ODP of Halon 1301. In an even more preferable embodiment, component compounds may be selected that have little or no ODP, ODP of 1 or less and result in a mixture with an ODP of 1 or less. In yet an even more preferable embodiment, component compounds are used that have an ODP of zero thus resulting in a mixture with an ODP of zero.

Another characteristic that maybe considered is global warming potential (GWP). The Global Warming Potential (GWP) is an index that provides a relative measure of the possible climate impact due to a compound, which acts as a greenhouse gas in the atmosphere. The GWP of a compound, as defined by the Intergovernmental Panel on Climate Change (IPCC), is calculated as the integrated radiative forcing due to the release of 1 kilogram of that compound relative to the warming due to 1 kilogram of $CO_2$ over a specified period of time (the integration time horizon (ITH)).

$$GWP_x = \frac{\int_0^{ITH} F_x C_{xe} \exp(-t/\tau_x)\,dt}{\int_0^{ITH} F_{CO_2} C_{CO_2}(t)\,dt}$$

Where F is the radiative forcing per unit mass of a compound (the change in the flux of radiation through the atmosphere due to the IR absorbance of that compound), C is the atmospheric concentration of a compound, $\tau$ is the atmospheric lifetime of a compound, t is time and x is the compound of interest.

The commonly accepted ITH is 100 years representing a compromise between short-term effects (20 years) and longer-term effects (500 years or longer). The concentration of an organic compound, x, in the atmosphere is assumed to follow pseudo first order kinetics (i.e., exponential decay). The concentration of $CO_2$ over that same time interval incorporates a more complex model for the exchange and removal of $CO_2$ from the atmosphere (the Bern carbon cycle model).

There are only two independent variables in the GWP calculation that are affected by the physical/environmental characteristics of the compound—the radiative forcing and the atmospheric lifetime. Hydrofluorocarbons (HFCs) and perfluorocarbons (PFCs) absorb infrared (IR) energy in the "window" at 8 to 12 μm which is largely transparent in the natural atmosphere. Absorption of IR energy within this atmospheric window is characteristic of all fluorinated compounds. As shown in FIG. 1, the radiative forcing values for PFCs and HFCs scale essentially linearly with the number of carbon-fluorine bonds due to the specific IR absorbance of those bonds at nominally 8 μm (1250 $cm^{-1}$). This IR absorbance, coupled with their relatively long atmospheric lifetimes, makes HFCs and PFCs greenhouse gases with high GWPs. Since all fluorinated compounds will absorb IR in these wavelengths, the most effective approach to producing low GWP alternatives is to develop compounds with shorter atmospheric lifetimes.

In a preferred embodiment, the component compounds comprising the mixture have a lower GWP than Halon 1301 and thus, the resultant mixture has a GWP less than Halon 1301. In a more preferable embodiment, the component compounds comprising the mixture have half or less the GWP of Halon 1301 resulting in a mixture with half or less the GWP of Halon 1301. In an even more preferable embodiment, component compounds are used that have a GWP of 1 thus resulting in a mixture with an GWP of 1.

Other characteristics of the component compounds that may be considered include but are not limited to a components fire suppression capability, toxicity to humans, destructive capability towards the zone it is being used to protect, and any other important fire suppression, retarding, or extinguishing properties.

There are a number of organic fire suppression compounds that are environmentally friendly. For example, FK-5-1-12, dodecafluoro-2-methylpentane-3-one, $C_6F_{12}O$, fluid is an environmentally friendly (ODP 0) fire suppression agent manufactured by 3M®. Organic fire suppressants include but are not limited to FK-5-1-12, dodecafluoro-2-methylpentan-one, $CF_3I$, compound similar to or derived from FK-5-1-12 and $CF_3I$, large high molecular weight organic molecules containing a halogen with boiling point temperature below that of FK-5-1-12, HFC-125, and other organics that may be used as fire suppressants, retardants, or extinguishers. In different embodiments, organic fire suppressants may be either halogenated or non-halogenated.

In some embodiments, components may be selected that in isolation have good fire suppressant qualities. However, in other embodiments, a component may be used that is not know to be a fire suppressant but has some other desirable quality that will enhance the effectiveness of the mixture. In yet other embodiments, component compounds may be used that in isolation are not fire suppressants but when mixed together create a mixture with fire suppressant characteristics.

FK-5-1-12, dodecafluoro-2-methylpentan-one is a high molecular weight material, compared with the first generation halocarbon clean agents. The product has a heat of vaporization of 88.1 kJ/kga and low vapor pressure. Although it is a liquid at room temperature, under normal temperatures it gasifies immediately after being discharged in a total flooding system.

FK-5-1-12 is based on a proprietary chemistry from 3M called C6-fluoroketone; it is also known as dodecafluoro-2-methylpentane-3-one; its ASHRAE nomenclature is FK 5-1-12—the way it is designated in NFPA 2001 and ISO 14520 clean agent standards. Chemically, it is a fluorinated ketone with the systematic name 1,1,1,2,2,4,5,5,5-nonafluoro-4-(trifluoromethyl)-3-pentanone and the structural formula $CF_3CF_2C(=O)CF(CF_3)_2$, a fully fluorinated analog of ethyl isopropyl ketone.

Another known fire suppressant that is less harmful to the ozone than Halon is Trifluoroiodomethane, also referred to as trifluoromethyl iodide. Trifluoroiodomethane is a halomethane with the formula $CF_3I$. It contains carbon, fluorine, and iodine atoms. Although iodine is several hundred times more efficient at destroying stratospheric ozone than chlorine, experiments have shown that because the weak C—I bond breaks easily under the influence of water (owing to the electron-attracting fluorine atoms), trifluoroiodomethane has an ozone depleting potential less than one-thousandth that of Halon 1301 (0.008-0.01). Its atmospheric lifetime, at less than 1 month, is less than 1 percent that of Halon 1301.

The problem with FK-5-1-12 and $CF_3I$ is that they have relatively high normal boiling points. The boiling point of a substance is the temperature at which the vapor pressure of the liquid equals the environmental pressure surrounding the liquid.

A liquid in a vacuum has a lower boiling point than when that liquid is at sea level atmospheric pressure. A liquid at high-pressure has a higher boiling point than when that liquid is at sea level atmospheric pressure. In other words, the boiling point of a liquid varies depending upon the surrounding environmental pressure. For a given pressure, different liquids boil at different temperatures.

The normal boiling point (also called the atmospheric boiling point or the atmospheric pressure boiling point) of a liquid is the special case in which the vapor pressure of the liquid equals the defined atmospheric pressure at sea level, 1 atmosphere. At that temperature, the vapor pressure of the liquid becomes sufficient to overcome atmospheric pressure and allow bubbles of vapor to form inside the bulk of the liquid. The standard boiling point is now (as of 1982) defined by IUPAC as the temperature at which boiling occurs under a pressure of 1 bar.

High boiling point agents such as FK 5-1-12 (normal boiling point of 49° C.) and $CF_3I$ (normal boiling point of −23° C.) do not freely vaporize below each respective boiling temperature. Consequently, in cold temperature environments like those found on an airplane at altitude, agent distribution must rely on atomization by mechanical treatment, or sheer momentum. This makes FK 5-1-12 and $CF_3I$ less than ideal replacements for Halon as aircraft fire suppressants when used by themselves. However, in embodiments of the present patent document, these agents may be blended with a compatible compound to modify their boiling point and thus, increase their effectiveness as fire suppressants in cold environments.

In some embodiments, FK 5-1-12 or $CF_3I$ may be blended with another organic compound with a lower boiling point to lower the boiling point of the organic fire suppressant. The result of the mixture, due to both materials being organic compounds and miscible within each other, is a liquid phase exhibiting a boiling point between that of the organic fire suppressant and the organic compound mixed with the organic fire suppressant.

The boiling point of a mixture is a function of the vapor pressures of the various components in the mixture. As a general trend, vapor pressures of liquids at ambient temperatures increase with decreasing boiling points. Raoult's law gives an approximation to the vapor pressure of mixtures of liquids. It states that the activity (pressure or fugacity) of a single-phase mixture is equal to the mole-fraction-weighted sum of the components' vapor pressures:

$$P_{tot} = \sum_i PiXi$$

where p is the mixture's vapor pressure, i is one of the components of the mixture and X is the mole fraction of that component in the liquid mixture. The term PiXi is the partial pressure of component i in the mixture. Raoult's Law is applicable only to non-electrolytes (uncharged species); it is most appropriate for non-polar molecules with only weak intermolecular attractions (such as London forces).

Systems that have vapor pressures higher than indicated by the above formula are said to have positive deviations. Such a deviation suggests weaker intermolecular attraction than in the pure components, so that the molecules can be thought of as being "held in" the liquid phase less strongly than in the pure liquid. An example is the azeotrope of approximately 95% ethanol and water. Because the azeotrope's vapor pressure is higher than predicted by Raoult's law, it boils at a temperature below that of either pure component.

There are also systems with negative deviations that have vapor pressures that are lower than expected. Such a deviation is evidence for stronger intermolecular attraction between the constituents of the mixture than exists in the pure components. Thus, the molecules are "held in" the liquid more strongly when a second molecule is present. An example is a mixture of trichloromethane (chloroform) and 2-propanone (acetone), which boils above the boiling point of either pure component.

In a preferred embodiment, an organic fire suppressant compound is mixed with a second organic compound with a lower boiling point to create a fire suppressant mixture with a lower boiling point than that of the organic fire suppressant compound. In an even more preferred embodiment, the fire suppressant mixture has little to no ODP and a low GWP. The lower boiling point improves free vaporization characteristics of the mixture.

In a preferred embodiment, the boiling point of the mixture is between 1 and 40 degrees Celsius lower than the boiling point of the organic fire suppressant compound by itself. In a more preferred embodiment, the boiling point of the mixture is between 40 and 75 degrees Celsius lower than the boiling point of the organic fire suppressant compound by itself. In an even more preferable embodiment, the boiling point of the mixture is between 75 and 100 degrees Celsius lower than the boiling point of the organic fire suppressant compound by itself.

Various types of organic compounds may be mixed with the organic fire suppressant to modify various different characteristics of the organic fire suppressant. Organic compounds that may be used include but are not limited to $CO_2$ and other organic compounds that exhibit desirable characteristics.

In one embodiment, FK 5-1-12 is mixed with carbon dioxide ($CO_2$). The boiling point of $CO_2$ at standard atmospheric pressure is −78.5° C. When mixed with Novec 1230, which has a boiling point of 49° C., the added $CO_2$ will lower the boiling point of the total mixture.

In addition to having a low boiling point, $CO_2$ may also be used as a fire suppressant and is environmentally friendly. However, $CO_2$ in large enough quantities to be a fire suppressant by itself is toxic to humans. When $CO_2$ is mixed with FK 5-1-12, the resultant mixture exhibits the advantageous properties of both of its components. Namely, an environmentally friendly fire suppressant with a lower boiling point that is safe for use around humans. The lower boiling point improves the mixtures free vaporization characteristics and helps it disperse better in air at cold temperatures and flood the area for which fire suppression is desired.

In different embodiments, different quantities of organic fire suppressants and organic compounds may be mixed together. These quantities may be determined based on the specific application the fire suppressant mixture is designed to be used in. For example, a requirement that the system be effective down to −60° C. may require more $CO_2$ to be added to the organic fire suppressant than if the environmental requirement were less extreme.

FIG. 1 illustrates how the vapor pressure of a mixture changes with the mole fraction of each of the components in the mixture. As explained above, the boiling point typically follows an inverse relationship to the vapor pressure. The solid lines represent the partial pressure of FK 5-1-12 and $CO_2$ in the mixture. The dashed line represents the vapor pressure of the mixture. As may be seen in FIG. 1, the vapor pressure transitions from that of pure FK 5-1-12 to that of pure $CO_2$ as the mole fraction of $CO_2$ is increased. FIG. 1 illustrates how the vapor pressure of the mixture is affected by increasing the concentration of $CO_2$ in the mixture and accordingly, the boiling point is lowered. While FIG. 1 uses FK 5-1-12 and $CO_2$ as examples, FIG. 1 is equally applicable to other mixtures of organic fire suppressants and organic compounds as explained above with respect to Raoult's law.

As explained above, the mixture ideally contains the advantageous properties of both of the components. Accordingly, in some embodiments more $CO_2$ may be used to lower the boiling point of the mixture and in other embodiments, less $CO_2$ may be used to retain more of the properties of the organic fire suppressant. As with most mixtures, there will be a saturation point at which the organic compound may stop actually mixing with the organic fire suppressant. For example, at some point $CO_2$ will stop actually mixing with the FK 5-1-12. This saturation point changes with temperature and more organic compound may be mixed with the organic fire suppressant at higher temperatures. In a preferred embodiment, approximately four (4) pounds of FK 5-1-12 are used for every one pound of $CO_2$, a mass ratio of approximately 4 to 1. In other embodiments, other ratios may be used.

When mixed in a mass ratio of 4 to 1, the resultant mixture has a boiling point of approximately −34° C. This is significantly lower than the 49° C. boiling point that FK 5-1-12 exhibits in isolation. Combining the fire suppression effectiveness of two physical acting agents results in a synergy between the agents to achieve fire suppression with a reduced concentration of $CO_2$, below 28%, and improved atomization of FK 5-1-12 at low temperatures.

In other embodiments of a fire suppressant mixture, $CF_3I$ may be mixed with CO2. Similar to FK 5-1-12, $CF_3I$ may be mixed with $CO_2$ in different ratios depending on the characteristics desired in the resultant mixture. In a preferred embodiment, $CF_3I$ is mixed with $CO_2$ in a 5 to 1 mass ratio. However, in other embodiments, other ratios may be used including 4 to 1.

In yet other embodiments of a fire suppression mixture, both FK 5-1-12 and $CF_3I$ may be mixed together with an organic compound such as $CO_2$. In some such embodiments, the total ration of organic fire suppressant to organic compound may be 4 to 1. In other such embodiments the ratio may be closer to 5 to 1. In still other such embodiments, the ratio may be even lower.

Fire suppression systems that deploy a mixture of an organic fire suppressant and an organic compound may be adapted to further increase the effectiveness of the fire suppressant mixture. One example of how a system may be adapted to further increase the effectiveness of the fire suppressant mixture is by keeping the mixture under a pressure. In a preferred embodiment, the system maintains the mixture under a pressure of approximately five (5) atmospheres all the way until the mixture is discharged from the system. In other embodiments, the system may pressurize the mixture to other pressure ranges. For example, in other embodiments, the system may maintain a pressure of 5-7 atmospheres on the mixture throughout the distribution system until a critical amount of the mixture has been discharged. In yet other embodiments, the system maintains 5-40 atmospheres of pressure on the mixture up through discharge.

Maintaining a positive pressure on the mixture may be advantageous not only to maintain a minimum mass flow rate to the discharge location but because certain compounds used in the mixture may have a tendency to solidify in cold temperatures if the pressure drops below a certain threshold. If either of the compounds in the mixture or a portion of the mixture solidifies, then it may clog the distribution system. If the solids that form do not clog the distribution system then they may be discharged in the solid state, which may cause damage to delicate equipment. For example, $CO_2$ has a triple point that occurs at −56.4° C. at a pressure of 5.4 atmospheres. The triple point of a substance is the temperature and pressure at which the three phases (gas, liquid, and solid) of that substance coexist in thermodynamic equilibrium. Accordingly, $CO_2$ may solidify within the system at cold temperatures if it not maintained at sufficient pressure.

In order to maintain the mixture under a positive pressure, a number of techniques may be used. For example, the fire suppression system may store the mixture in a pressurized vessel. Pressure may be added to the vessel with an inorganic pressurizing gas. In the preferred embodiment, the inorganic pressurizing gas is inert. In a more preferred embodiment the inorganic pressurizing gas is nitrogen. In yet other embodiments, the pressurizing gas may be argon, or helium. Discharge rates at low temperatures, similar to discharge rates of Halon 1301 at low temperatures, may be accommodated by adding nitrogen or another suitable pressurizing gas.

At low temperatures such as those found on aircraft at altitude, the fire suppressant, which may be a mixture, may be a two phase (liquid and vapor) fire suppressant instead of a single phase (gas only). Pressurizing with an inert gas may also be advantageous to provide low temperature energy for proper expulsion of a two phase fire suppressing mixture.

Figure 3:
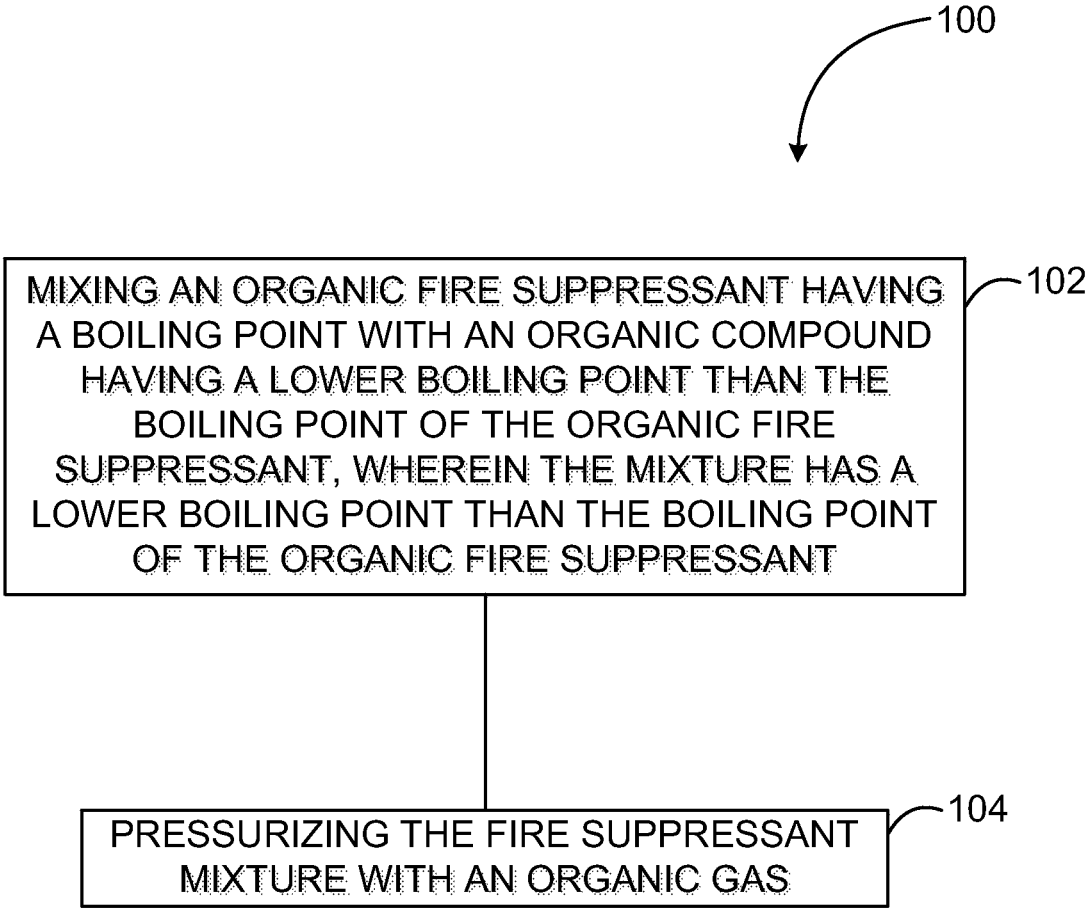
FIG. 3 illustrates a method of creating a fire suppressant mixture for use in a fire suppression system.

FIG. 3 illustrates a fire suppression system 200 for distributing a fire suppression mixture. Fire suppression system 200 includes container 202 for storing the fire suppression mixture. The container 202 may be any type of container designed to hold a fire suppression mixture. In the preferred embodiment, container 202 is designed to hold the fire suppression mixture under pressure.

Container 202 is in selective communication with distribution tubing 206, 208, 210 and 212. When the fire suppression system 200 is activated, container 202 releases the fire suppressant mixture into tubing 206, 208, 210 and 212. Tubing 206, 208, 210 and 212 may be tubing, piping or any other type of structure designed to distribute liquid or gases. The mixture is forced through the tubing and exits the fire suppression system 200 at discharge locations 204.

The tubing/piping may be made from plastic, rubber, metal, polyvinyl chloride (PVC) or any other type of suitable material. In a preferred embodiment, the material of the tubing should be selected to be inert with respect to the fire suppression mixture it distributes.

In some embodiments of the fire suppression system 200, the system 200 delivers the mixture all the way to the discharge locations 204 while maintaining a minimum pressure on the mixture during distribution by maintaining a back pressure. In one embodiment, the discharge geometry at each distribution location 204 is designed to maintain a positive back pressure above a certain threshold. In such an embodiment, the geometry at the distribution locations 204 restricts flow and maintains the pressure in the system 200 until substantially all the mixture has exited each discharge location 204. In some embodiments, valves or nozzles may be used to control the geometry at the discharge locations 204 and maintain the minimum pressure throughout the system.

In other embodiments of system 200, the exit geometry at the discharge locations 204 may not regulate the pressure but instead the pressure may be regulated by the geometric or physical design of the distribution system itself. In one such embodiment, the tubing or piping 206, 208, 210 and 212 may be designed to maintain a minimum pressure throughout the system 200. For example, by designing the system with the appropriate amount of direction changes and increasing smaller tubing, the mixture may be distributed throughout a fire suppression zone while still maintaining a minimum pressure throughout the system. This may all be achieved without pressure sensitive valves or nozzles at the discharge locations 204.

As shown in FIG. 3, the tube 206 that is directly downstream from container 202 has a diameter D. In the embodiment shown in FIG. 3, the diameter of the tube at each successive downstream branch is smaller i.e., D1 is smaller than D and D2 is smaller than D1 and D3 is smaller than D2. The diameter D along with the successive downstream diameters D1-D3 should be selected based on the minimum pressure required to be maintained. The number of branches in the overall tube design may also be used to help maintain a minimum pressure. The forced rapid changes in direction may help maintain the pressure upstream from the branch.

Designing a system that does not require a pressure sensitive valve or nozzle at the discharge point may not only be important for safety reasons, but may also be important for retrofitting capabilities. Most current systems do not use such discharge geometry and therefore, using the geometry of the distribution tubing or piping to maintain a minimum pressure may be advantageous.

In other systems the exit geometry of the discharge locations 204 and the geometry of the tubing may both be designed to help the system 200 maintain a minimum pressure through during operation. In a preferred embodiment of the distribution system 200, the tubing diameter and nozzle throat diameter is selected to meet focused concentration, to suppress combustion, and maintain sufficient line pressure to expel liquid phase from the system 200 before a critical low pressure value is reached, approximately 6 atmospheres.

In some embodiments, an additional optional container 214 may be used to hold pressurizing gas. Container 214 is in selective communication with container 202 such that as the fire suppressant mixture is expelled from container 202, the pressurizing gas fills the container 202 and prevents the pressure in container 202 from substantially falling. This also helps maintain a minimum pressure throughout the system 200. In some embodiments, the optional container 214 may not be used.

As explained above, certain proportions of an organic fire suppressant with a high normal boiling point, such as FK 5-1-12, and an organic compound with a low normal boiling point, such as carbon dioxide, under high pressure, result in desirable combined physical properties upon discharge at low temperature. The combination greatly improves the fire suppression properties of either agent separately. The addition of nitrogen, argon, or helium, may be supplemented to increase bottle pressure at low temperatures providing acceptable mass flow at these temperatures. The addition of these inert gases also prevents triple point behavior of the $CO_2$ component during discharge at these low temperatures.

FIG. 3 illustrates a method of making a fire suppressant mixture for use in a fire suppression system 100. As shown in step 102 of FIG. 3, an organic fire suppressant is mixed with an organic compound in order to modify a characteristic of the organic fire suppressant. In the embodiment shown in FIG. 3, the method is used to modify the boiling point of the organic fire suppressant. Once the mixture of the organic fire suppressant and the organic compound is complete, the mixture may be pressurized using an inorganic gas in step 104. It is important to make sure the mixture of the fire suppressant compound and the organic compound is performed before the inorganic gas is introduced, especially if the organic compound is being added to its maximum saturation point or close thereto.

Although the embodiments have been described with reference to preferred configurations and specific examples, it will readily be appreciated by those skilled in the art that many modifications and adaptations of the fire suppressing materials and systems, and methods of using fire suppressing materials described herein are possible without departure from the spirit and scope of the embodiments as claimed hereinafter. Thus, it is to be clearly understood that this description is made only by way of example and not as a limitation on the scope of the embodiments as claimed below.

What is claimed is:

1. A fire suppressant mixture consisting essentially of:

an organic fire suppressant selected from the group consisting of FK 5-1-12 and $CF_3I$ carbon dioxide; and, a pressurizing gas selected from the group consisting of nitrogen, argon and helium;

wherein enough carbon dioxide is present in the fire suppressant mixture such that a normal boiling point of the fire suppressant mixture is at least 40 degrees Celsius lower than a normal boiling point of the organic fire suppressant.

2. The fire suppressant mixture of claim 1, wherein the organic fire suppressant-is FK 5-1-12.

3. The fire suppressant mixture of claim 1, wherein the pressurizing gas is nitrogen.

4. The fire suppressant mixture of claim 1, wherein the mass ratio of the organic fire suppressant to carbon dioxide is approximately 4 to 1.

5. The fire suppressant mixture of claim 1, wherein the organic fire suppressant is $CF_3I$.

6. The fire suppressant mixture of claim 2, wherein the organic fire suppressant compound is a mixture of both FK 5-1-12 and $CF_3I$.

7. The fire suppressant mixture of claim 6, wherein the organic fire suppressant and the carbon dioxide have a weight ratio of about 4 to 1, respectively, to about 5 to 1, respectively.

8. The fire suppressant mixture of claim 1, wherein the normal boiling point of the fire suppressant mixture is between 40 and 75 degrees Celsius lower than the normal boiling point of the organic fire suppressant.

9. The fire suppressant mixture of claim 1, wherein the normal boiling point of the fire suppressant mixture is at least 75 degrees Celsius lower than the normal boiling point of the organic fire suppressant.

10. The fire suppressant mixture of claim 1, wherein the normal boiling point of the fire suppressant mixture is between 75 and 100 degrees Celsius lower than the normal boiling point of the organic fire suppressant.

11. The fire suppressant mixture of claim 1, wherein the organic fire suppressant and the carbon dioxide have a weight ratio of about 4 to 1, respectively, to about 5 to 1, respectively.

12. A fire suppressant mixture consisting essentially of:

FK 5-1-12;

carbon dioxide; and, a pressurizing gas other than carbon dioxide;

wherein enough carbon dioxide is present in the fire suppressant mixture such that a normal boiling point of the fire suppressant mixture is at least 75 degrees Celsius lower than a normal boiling point of FK 5-1-12.

13. The first suppressant mixture of claim 12, wherein the pressurizing gas is selected from the group consisting of nitrogen, argon and helium.

14. The fire suppressant mixture of claim 13, wherein the normal boiling point of the fire suppressant mixture is between 75 and 100 degrees Celsius lower than the normal boiling point of FK 5-1-12.

15. The fire suppressant mixture of claim 12, wherein the pressurizing gas is nitrogen.

* * * * *